US007246707B2

(12) United States Patent
Black

(10) Patent No.: US 7,246,707 B2
(45) Date of Patent: Jul. 24, 2007

(54) TWO-SLAT DESIGN FOR A SMALL PIECE REMOVER

(75) Inventor: Ronald Black, Bakersfield, CA (US)

(73) Assignee: Grimmway Enterprises, Inc., Bakersfield, CA (US)

( * ) Notice: Subject to any disclaimer, the term of this patent is extended or adjusted under 35 U.S.C. 154(b) by 41 days.

(21) Appl. No.: 11/007,803

(22) Filed: Dec. 7, 2004

(65) Prior Publication Data

US 2006/0163124 A1 Jul. 27, 2006

(51) Int. Cl.
*B07C 5/12* (2006.01)

(52) U.S. Cl. ..... 209/684

(58) Field of Classification Search ..... 209/684–687, 209/689–692, 274
See application file for complete search history.

(56) References Cited

U.S. PATENT DOCUMENTS

| | | | | | |
|---|---|---|---|---|---|
| 73,736 | A | * | 1/1868 | McCulloch | 209/686 |
| 250,870 | A | * | 12/1881 | Bales | 209/685 |
| 491,594 | A | * | 2/1893 | Rich | 209/685 |
| 788,839 | A | * | 5/1905 | MacDonald | 209/616 |
| 1,221,855 | A | * | 4/1917 | Hicks | 99/617 |
| 1,675,049 | A | * | 6/1928 | Perkins | 209/685 |
| 3,612,273 | A | * | 10/1971 | Pritchett | 209/687 |
| 4,884,700 | A | * | 12/1989 | Allgauer et al. | 209/685 |
| 5,394,792 | A | * | 3/1995 | Satake et al. | 99/519 |
| D505,682 | S | * | 5/2005 | Hisamistu | D15/28 |

OTHER PUBLICATIONS

Farmco Small Piece Remover, Key Technology, Inc. Admitted Prior Art, before Dec. 7, 2004.*

* cited by examiner

*Primary Examiner*—Joseph C. Rodriguez
(74) *Attorney, Agent, or Firm*—Townsend and Townsend and Crew LLP

(57) ABSTRACT

A slat arrangement for use with an apparatus that removes undesirable pieces from a plurality of pieces based upon size. The slat arrangement comprises a plurality of slats, wherein adjacent slats define a plurality of pockets.

7 Claims, 3 Drawing Sheets

TWO-SLAT DESIGN FOR A SMALL PIECE REMOVER

CROSS-REFERENCES TO RELATED APPLICATIONS

NOT APPLICABLE

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

1. Field of the Invention

The present invention relates to slats for removing undesirable pieces with an apparatus, and more particularly, to a slat arrangement wherein two adjacent slats define pockets for removing small or undesirable pieces with a small piece remover.

2. Description of the Prior Art

Often among a plurality of products, there are undesirable products. This can be true of manufactured items as well as agricultural items. For example, with vegetables such as, for example, baby carrots, pea pods, and carrot pieces, size is an important factor for determining desirability. In particular applications, certain sized carrot pieces, baby carrots or pea pods are unacceptable. Thus, smaller carrots and pea pods are removed.

A current machine for removing small pieces is a Small Piece Remover™ that is manufactured and marketed by Farmco, Inc., based in Redmond, Oreg. This device works with a plurality of adjacent slats, wherein each slat has a plurality of pockets defined therein. The slats are arranged in a side-by-side relationship along a looping conveyor. The device is set up at an angle such that a first side is higher than a second side. This angle is substantially perpendicular to the direction of travel for the plurality of slats.

In use, products, such as baby carrots, are placed on the slats. The looping slats are arranged such that they define a trough along the angled direction. The slats move and smaller baby carrots fall into the pockets while the larger, more desirable, baby carrots move through the defined trough until they fall off the device while the smaller carrots are carried by the pockets up and out of the defined trough and fall out of the pockets as the slats loop around. Thus, the smaller, more undesirable baby carrots are separated from the more desirable baby carrots.

Unfortunately, this slat design does not work well, especially with larger diameter baby carrots. Accordingly, an improved slat design and arrangement is needed.

SUMMARY OF THE INVENTION

The present invention provides a slat arrangement for use with an apparatus that removes undesirable pieces from a plurality of pieces based upon size. The slat arrangement comprises a plurality of slats, wherein adjacent slats define a plurality of pockets.

In accordance with one aspect of the present invention, the plurality of pockets are angularly oriented with respect to a major access defined by the slats.

In accordance with another aspect of the present invention, half of the plurality of pockets are angularly oriented in a first direction and half of the plurality of pockets are angularly oriented in a second direction.

In accordance with a further aspect of the present invention, the pockets are substantially elliptical in shape.

In accordance with another aspect of the present invention, the pockets are approximately two inches long.

In accordance with a further aspect of the present invention, the pockets are substantially circular in shape.

In accordance with another aspect of the present invention, the circular pockets have a diameter of approximately two inches.

The present invention also provides a slat for use with an apparatus that removes undesirable pieces from a plurality of pieces based upon size. A slat comprises an elongated body and a plurality of semi-pockets defined within the body and arranged in a staggered side-by-side relationship. Each of the semi-pockets faces outwardly.

Other features and advantages of the present invention will be apparent upon review of the following detailed description of preferred exemplary embodiments.

DETAILED DESCRIPTION OF THE INVENTION

Figure 1:
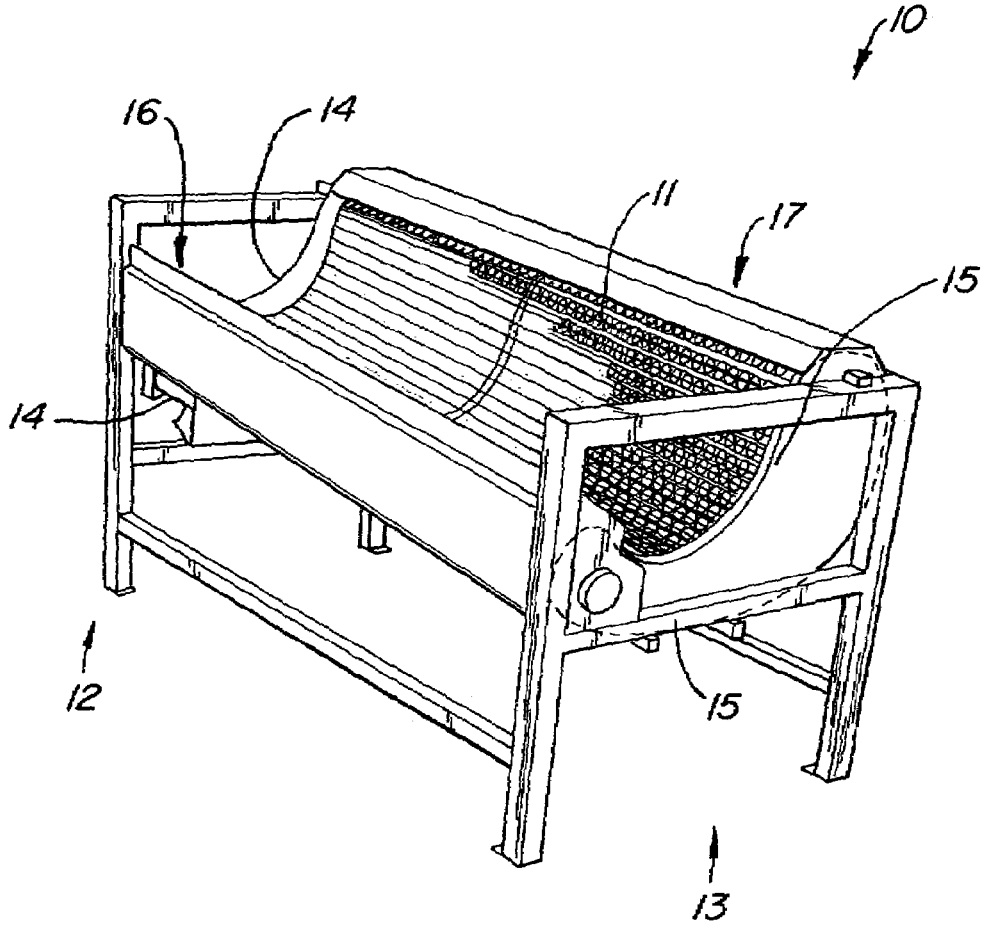
FIG. 1 is a perspective view of an apparatus that uses a two-slat design in accordance with the present invention.
Figure 2:
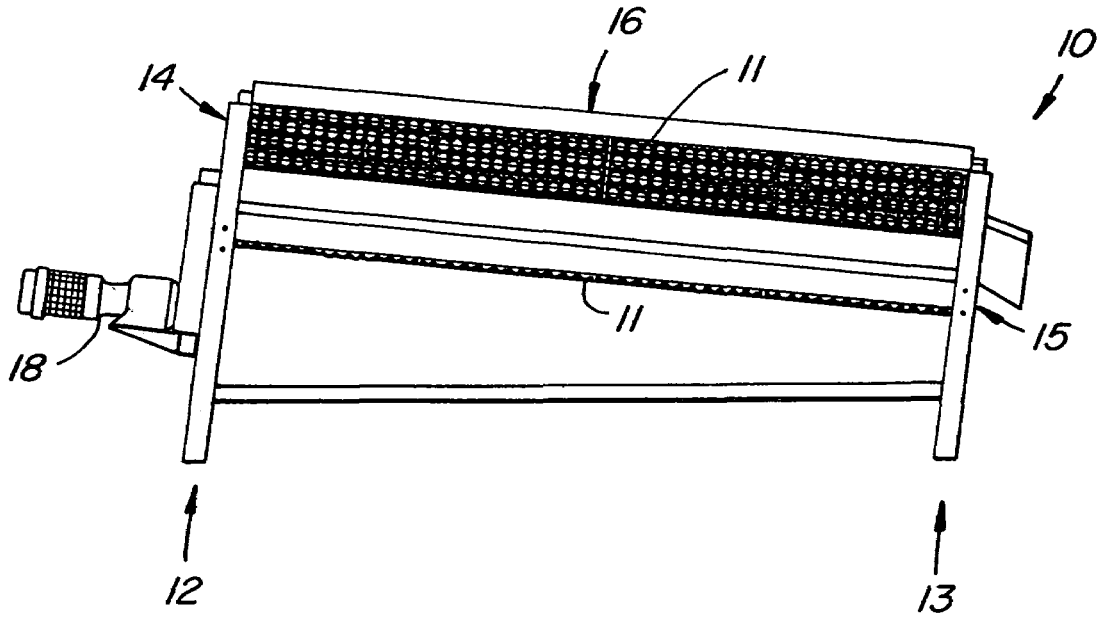
FIG. 2 is a side view of the apparatus illustrated in FIG. 1.

FIGS. 1 and 2 illustrate an apparatus 10 that removes small pieces with slats 11. The apparatus illustrated in FIGS. 1 and 2 is a Small Piece Remover™ and is available from Farmco, Inc., which is based in Redmond, Oreg. As may be seen, the apparatus comprises a base that includes a first side 12 and a second side 13. The first side is higher than the second side. The first and second sides define a direction of product travel therebetween. Those skilled in the art will understand that other types of machines may be used with the present invention.

A plurality of slats 11 are provided between the first and second side. The slats are coupled at the first and second sides to looping drive chains 14, 15 to form a conveyor. Preferably, two slats are placed end to end between sides 12, 13 and therefore coupled a slat connector block (not shown) in the middle of apparatus 10. The drive chains are looped around various sprockets and gears (not shown). A drive motor 18 is provided that drives at least one sprocket or gear on at least one side to thereby drive at least one drive chain. As may be seen in FIG. 1, the drive chains, and thereby the slats, are arranged such that they define a trough between sides 16 and 17.

Figure 3:
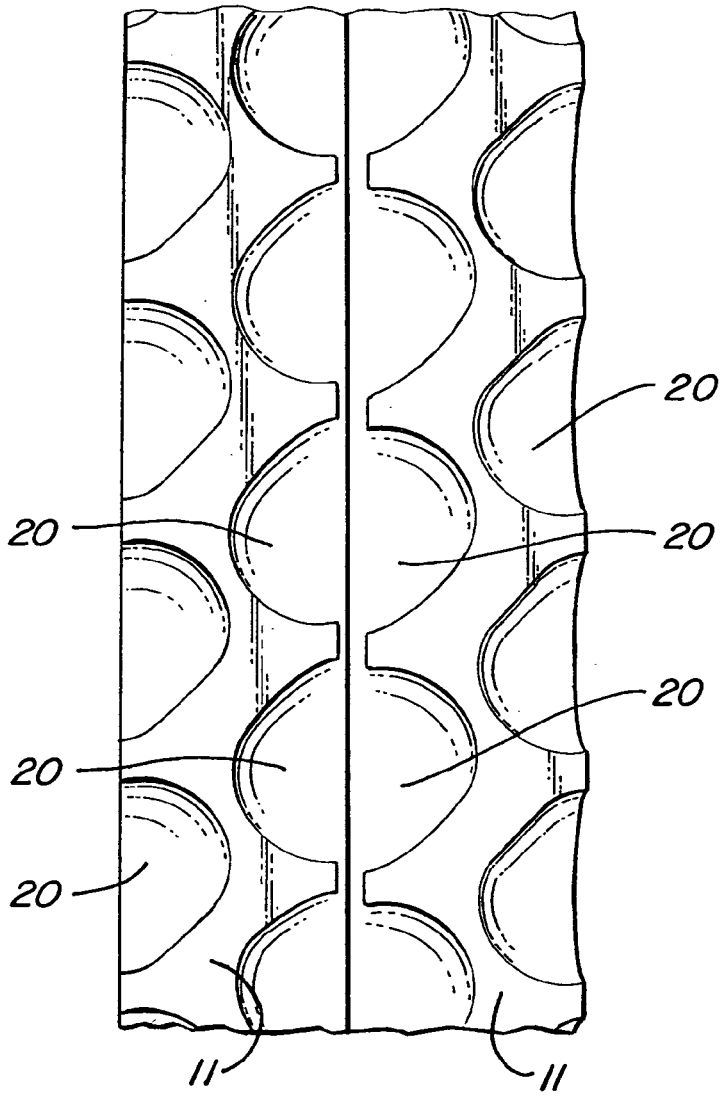
FIG. 3 is an enlarged view of a portion of two slats in accordance with the present invention.
Figure 4:
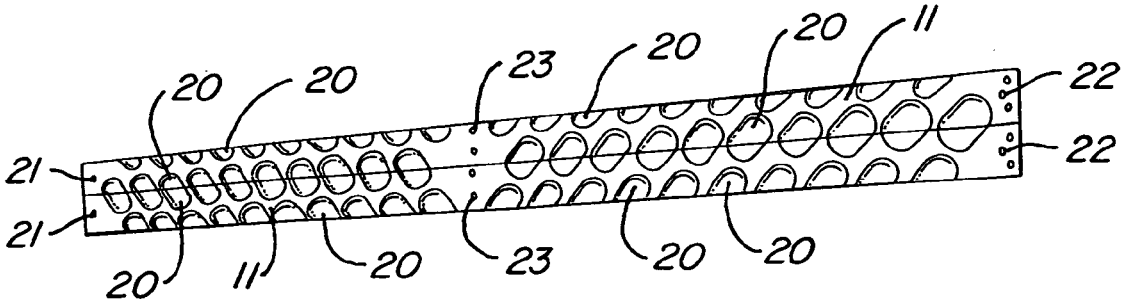
FIG. 4 is a perspective view of two slats in accordance with the present invention.

As may be seen in FIGS. 3 and 4, a slat design is illustrated in accordance with the present invention. The slats include a plurality of semi-pockets 20. The semi-pockets face outwardly such that, as may be seen especially in FIG. 3, adjacent slats form full pockets with the semi-pockets form. As may be seen in FIGS. 3 and 4, preferably the semi-pockets are arranged in a substantially side-by-side relationship and yet are slightly staggered. Additionally, as may be seen in FIG. 4, preferably approximately half of the semi-pockets are oriented at an angle in a first direction, while the other approximately half of the semi-pockets are angularly oriented in a second direction with respect to a longitudinal axis L defined by the slats.

As may be seen in FIG. 4, the slats include openings 21, 22 at the first and second ends for coupling the slats to the drive chains and the connector block on the small piece remover.

The slats are preferably made of a food grade plastic. As an example, each slat preferably has a length of approximately three feet, a width of approximately two inches and a thickness or height of approximately one inch. The semi-pockets are preferably one inch long and are preferably slightly semi-elliptical in shape so that adjacent slats define slightly elliptical pockets. Alternatively, the semi-pockets may be semi-circular so that adjacent slats define circular pockets.

In use, products such as baby carrots or snap peas, for example, are provided at first side 12 at the bottom of the defined trough. The drive chains move the slats toward side 16 of the small piece remover. Thus, anything within the pockets defined by adjacent slats will move up and over this side of the small piece remover and as the slats loop around, they will fall from the pockets. Pieces that are not within the pockets will not be able to move up and over this end of the small piece remover and therefore will stay within the defined trough. Because of the angle of the small piece remover defined by sides 12 and 13 and the movement of the slats, pieces not within the pocket will work their way through the trough and eventually fall from second side 13. Thus, since these pieces did not "fit" within the defined pockets, they are as large or larger than a desired, predetermined size.

Accordingly, the present invention provides a two-slat design that allows for improved removal of undesirable pieces based upon size. The size, shape and orientation of the semi-pockets, and thereby the pockets, allow for improved selection and removal of undesirable pieces. Those skilled in the art will understand that other sizes for the semi-pockets, and thereby the pockets, may be utilized to control the size of the undesired pieces that are removed with the pockets.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A slat for use with an apparatus that removes undesirable pieces from a plurality of pieces based upon size, the slat comprising an elongated body and a plurality of semi-pockets defined within the body and arranged in a staggered side-by-side relationship, wherein each semi-pocket faces outwardly, wherein the plurality of semi-pockets are angularly oriented with respect to a major axis defined by the body, and wherein half of the plurality of semi-pockets are angularly oriented in a first direction and half of the plurality of semi-pockets are angularly oriented in a second direction.

2. The slat in accordance with claim 1 wherein the semi-pockets are substantially semi-elliptical in shape.

3. The slat in accordance with claim 2 wherein the semi-pockets are approximately one inch long.

4. An apparatus for removing undesirable pieces from a plurality of pieces based upon size, the apparatus comprising:

a base comprising a first side and a second side and defining a direction of product travel therebetween, the first side having a greater height than the second height;

a first end drive chain located at the first side;

a second end drive chain located at the second side;

drive means for driving at least one drive chain in a direction substantially perpendicular to the direction of product travel; and a plurality of elongated slats each having a first end and a second end, the first ends being coupled to the first end drive chain and the second ends being coupled to the second end drive chain, each slat comprising an elongated body and a plurality of semi-pockets defined within the body and arranged in a side-by-side relationship, wherein each semi-pocket faces outwardly such that adjacent slats define a plurality of pockets, wherein the plurality of pockets are angularly oriented with respect to a major axis defined by the slats, and wherein half of the plurality of pockets are angularly oriented in a first direction and half of the plurality of pockets are angularly oriented in a second direction.

5. The apparatus in accordance with claim 4 wherein the pockets are substantially elliptical in shape.

6. The apparatus in accordance with claim 5 wherein the pockets are approximately two inches long.

7. A method of removing undesirable pieces from a plurality of pieces based upon size, the method comprising:

providing an apparatus comprising:

a base comprising a first side and a second side and defining a direction of product travel therebetween, the first side having a greater height than the second height;

a first end drive chain defining a first loop located at the first side;

a second end drive chain defining a second loop located at the second side;

drive means for driving the drive chains in a direction substantially perpendicular to the direction of product travel; and a plurality of elongated slats each having a first end and a second end, the first ends being coupled to the first end drive chain and the second ends being coupled to the second end drive chain, each slat comprising an elongated body and a plurality of semi-pockets defined within the body and arranged in a side-by-side relationship, wherein each semi-pocket faces outwardly wherein semi-pockets of adjacent slats combine to form a plurality of pockets wherein the plurality of pockets are angularly oriented with respect to a major axis defined by the slats, and wherein half of the plurality of pockets are angularly oriented in a first direction and half of the plurality of pockets are angularly oriented in a second direction;

providing a plurality of pieces to the apparatus such that the pieces engage the plurality of slats; and driving the drive chains in a direction of travel substantially perpendicular to the direction of product travel;

wherein undesirable pieces enter the pockets due to their size and are thereby moved in a direction substantially perpendicular to the direction of product travel until they fall from the pockets as the chains move the slats around the loops; and wherein desirable pieces move along the direction of product travel.

* * * * *